US010820662B2

(12) United States Patent
Paris

(10) Patent No.: US 10,820,662 B2
(45) Date of Patent: Nov. 3, 2020

(54) ACCESSORIZED FOOTWEAR

(71) Applicant: Anthony Paris, Indianpolis, IN (US)

(72) Inventor: Anthony Paris, Indianpolis, IN (US)

( * ) Notice: Subject to any disclaimer, the term of this patent is extended or adjusted under 35 U.S.C. 154(b) by 85 days.

(21) Appl. No.: 16/182,675

(22) Filed: Nov. 7, 2018

(65) Prior Publication Data

US 2020/0138148 A1 May 7, 2020

(51) Int. Cl.
*A43B 23/00* (2006.01)
*A43C 19/00* (2006.01)
*A47G 25/82* (2006.01)

(52) U.S. Cl.
CPC ..... *A43C 19/00* (2013.01); *A47G 25/82* (2013.01)

(58) Field of Classification Search
CPC ..... A43C 19/00; A43B 3/166; A43B 23/22; A43B 3/30
USPC ..... 36/136, 70 R, 73–74
See application file for complete search history.

(56) References Cited

U.S. PATENT DOCUMENTS 640,277 A 1/1900 Daniels
806,579 A 12/1905 Schakel
6,701,582 B1 3/2004 Milburn
D536,516 S 2/2007 Sanders
7,237,306 B1 7/2007 Flowers
7,793,438 B1 * 9/2010 Busse ..... A43B 11/02 36/105
7,797,762 B2 9/2010 Shapiro
8,256,146 B2 * 9/2012 Loverin ..... A43B 3/30 36/102
9,044,054 B2 * 6/2015 Raymer, Jr. ..... A41D 27/12
2008/0289225 A1 11/2008 Ali
2010/0011626 A1 * 1/2010 Ali ..... A41F 17/00 36/70 R
2010/0205719 A1 8/2010 Shires

FOREIGN PATENT DOCUMENTS

WO WO2007094964 8/2007

* cited by examiner

*Primary Examiner* — Timothy K Trieu

(57) ABSTRACT

Accessorized footwear for preventing a pant leg from entering a shoe includes a shoe. A sheath is positioned in a heelcap of the shoe. The sheath extends from proximate to a heel to proximate to a topline of the shoe so that the sheath substantially bisects the heelcap. A shaft is selectively extensible from the sheath and is configured to extend proximate to an Achilles tendon of a foot that is positioned in the shoe. The shaft is positioned to deflect a bottom of a pant leg from entering a gap between the heelcap and the foot.

8 Claims, 3 Drawing Sheets

ACCESSORIZED FOOTWEAR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to footwears and more particularly pertains to a new footwear for preventing a pant leg from entering a shoe.

BRIEF SUMMARY OF THE INVENTION

An embodiment of the disclosure meets the needs presented above by generally comprising a shoe. A sheath is positioned in a heelcap of the shoe. The sheath extends from proximate to a heel to proximate to a topline of the shoe so that the sheath substantially bisects the heelcap. A shaft is selectively extensible from the sheath and is configured to extend proximate to an Achilles tendon of a foot that is positioned in the shoe. The shaft is positioned to deflect a bottom of a pant leg from entering a gap between the heelcap and the foot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
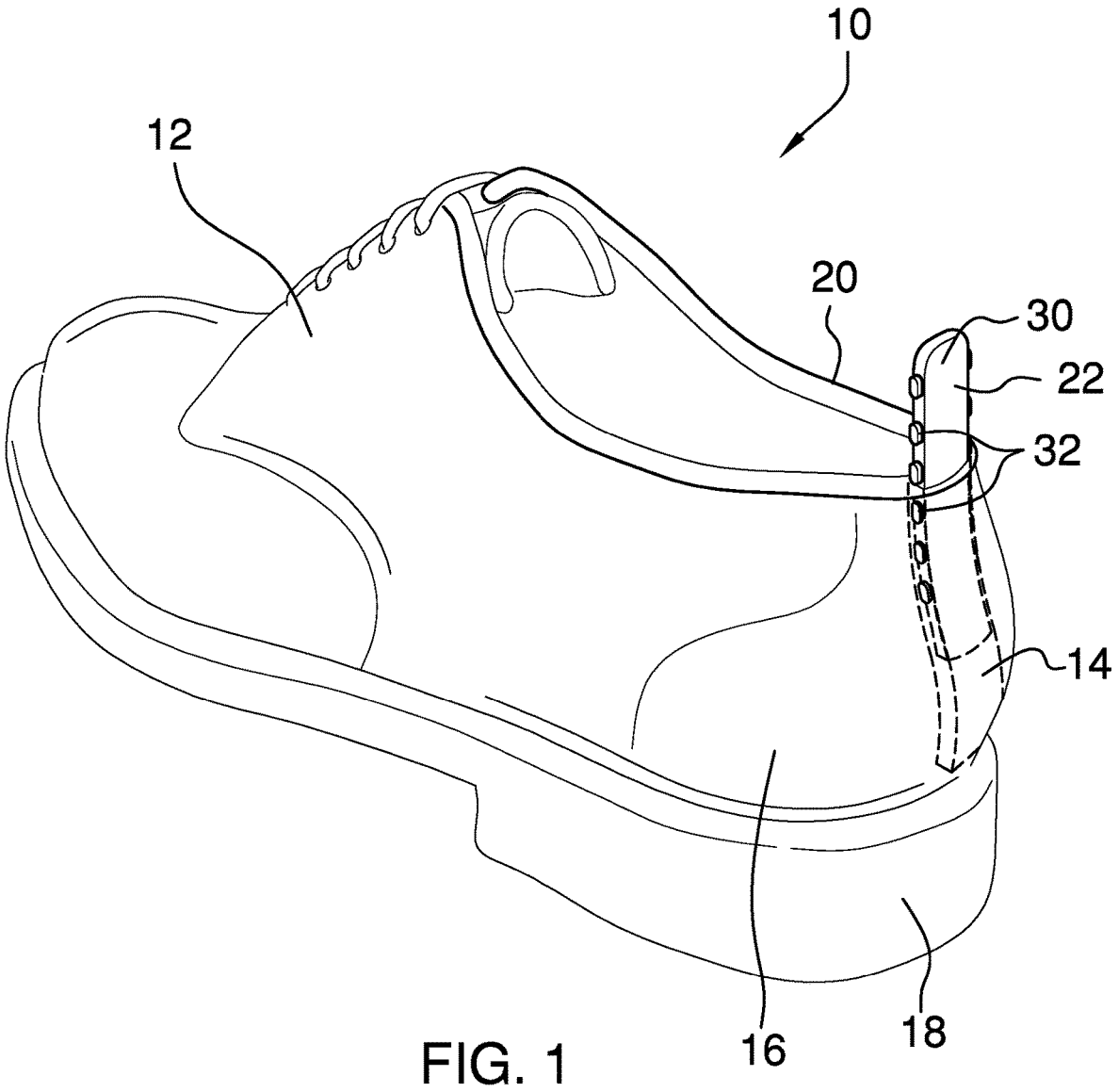
FIG. 1 is an isometric perspective view of accessorized footwear according to an embodiment of the disclosure.

With reference now to the drawings, and in particular to FIGS. 1 through 4 thereof, a new footwear embodying the principles and concepts of an embodiment of the disclosure and generally designated by the reference numeral 10 will be described.

Figure 2:
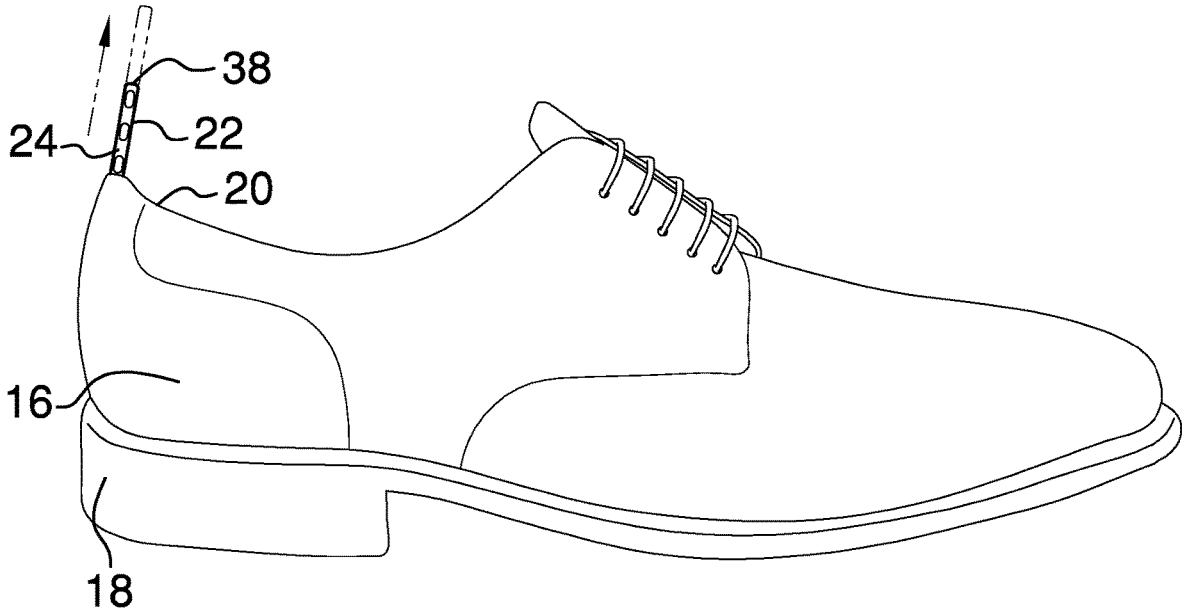
FIG. 2 is a side view of an embodiment of the disclosure.
Figure 3:
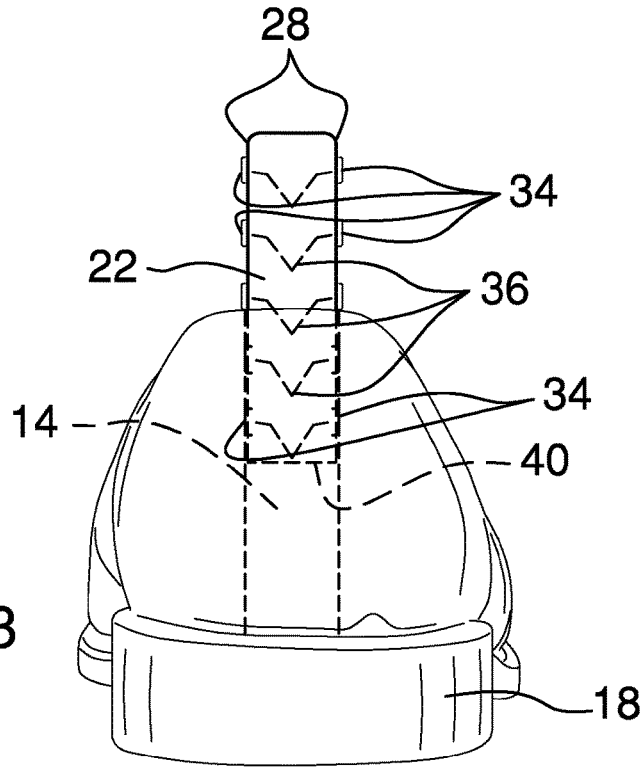
FIG. 3 is a back view of an embodiment of the disclosure.

As best illustrated in FIGS. 1 through 4, the accessorized footwear 10 generally comprises a shoe 12. A sheath 14 is positioned in a heelcap 16 of the shoe 12. The sheath 14 extends from proximate to a heel 18 to proximate to a topline 20 of the shoe 12 so that the sheath 14 substantially bisects the heelcap 16, as shown in FIG. 3.

Figure 4:
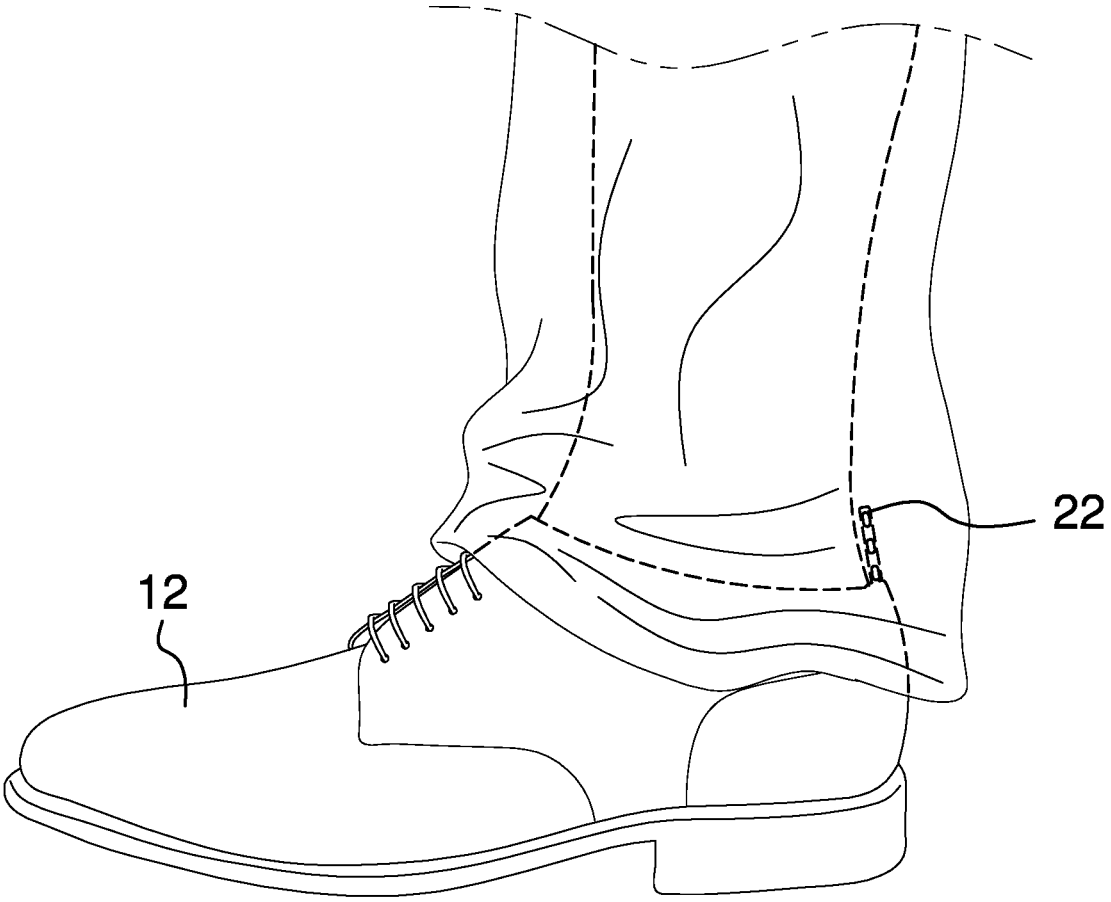
FIG. 4 is an in-use view of an embodiment of the disclosure.

A shaft 22 is selectively extensible from the sheath 14, as shown in FIG. 2, and is configured to extend proximate to an Achilles tendon of a foot that is positioned in the shoe 12. The shaft 22 is positioned to deflect a bottom of a pant leg from entering a gap between the heelcap 16 and the foot, as shown in FIG. 4. The shaft 22 can also function as a shoehorn 24 to assist a user in positioning the foot in the shoe 12.

The shaft 22 is substantially rectangularly shaped when viewed from a back 26 of the shoe 12, as shown in FIG. 3. The shaft 22 has upper corners 28 that are arcuate so that the upper corners 28 do not catch skin of the user or the pant leg. The shaft 22 comprises metal to that the shaft 22 is configured to flex as the user walks.

A sleeve 30 is positioned over and is coupled to the shaft 22. The sleeve 30 is configured to pad the shaft 22 so that the shaft 22 can rest comfortably against the skin of the user. The sleeve 30 comprises at least one of rubber, silicone, and plastic.

A coupler 32 is coupled to the shaft 22. The coupler 32 is selectively couplable to the heelcap 16 and is positioned to couple to the heelcap 16 to fixedly position the shaft 22 relative to the sheath 14.

The coupler 32 comprises a plurality of pairs of pins 34 and a plurality of springs 36, as shown in FIG. 3. The plurality of pairs of pins 34 extends from proximate to an upper end 38 to proximate to a lower end 40 of the shaft 22. Each pin 34 of a respective pair of pins 34 extends from a respective opposing side 42 of the shaft 22. Each spring 36 is coupled to and extends between the pins 34 of a respective pair of pins 34, as shown in FIG. 3, so that the pins 34 of the respective pair of pins 34 are biased to an extended position. The pins 34 of the respective pair of pins 34 are positioned to extend from the shaft 22 over the topline 20 of the shoe 12 as the shaft 22 is extended from the sheath 14. The pins 34 of the respective pair of pins 34 retain the shaft 22 in an extended configuration. The pins 34 of the respective pair of pins 34 are configured to be depressed to insert the shaft 22 into the sheath 14. The plurality of pairs of pins 34 comprises six pairs of pins 34.

In use, the upper end 38 of the shaft 22 is grasped in digits of a hand of the user and pulled to extend the shaft 22 from the sheath 14. The respective pair of pins 34 extends from the shaft 22 to engage the topline 20 of the shoe 12 to retain the shaft 22 in the extended position. The shaft 22 deflects the bottom of the pant leg from entering the gap between the heelcap 16 and the foot.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. Accessorized footwear comprising:

a shoe;

a sheath positioned in a heelcap of the shoe, the sheath extending upwardly substantially to a topline of the shoe such that the sheath substantially bisects the heelcap; and a shaft selectively extensible from the sheath wherein the shaft is configured for extending proximate to an Achilles tendon of a foot of a wearer positioned in the shoe such that the shaft is positioned for deflecting a bottom of a pant leg from entering a gap between the heelcap and the foot;

a coupler coupled to the shaft, the coupler being selectively couplable to the heelcap wherein the coupler is positioned for coupling to the heelcap for fixedly positioning the shaft relative to the sheath, the coupler comprising a plurality of pairs of pins, the plurality of pairs of pins extending from proximate to an upper end to proximate to a lower end of the shaft, each pin of a respective pair of pins extending from a respective opposing side of the shaft, and a plurality of springs, each spring being coupled to and extending between the pins of a respective pair of pins such that the pins of the respective pair of pins are biased to an extended position wherein the pins of the respective pair of pins are positioned for extending from the shaft over the topline of the shoe as the shaft is extended from the sheath for retaining the shaft in an extended configuration, wherein the pins of the respective pair of pins are configured for depressing for inserting the shaft into the sheath.

2. The footwear of claim 1, further including the shaft being substantially rectangularly shaped when viewed from a back of the shoe.

3. The footwear of claim 2, further including the shaft having upper corners, the upper corners being arcuate.

4. The footwear of claim 1, further including the shaft comprising metal.

5. The footwear of claim 1, further including a sleeve positioned over and coupled to the shaft wherein the sleeve is configured for padding the shaft.

6. The footwear of claim 5, further including the sleeve comprising at least one of rubber, silicone, and plastic.

7. The footwear of claim 1, further including the plurality of pairs of pins comprising six pairs of pins.

8. Accessorized footwear comprising:

a shoe;

a sheath positioned in a heelcap of the shoe, the sheath extending upwardly substantially to a topline of the shoe such that the sheath substantially bisects the heelcap;

a shaft selectively extensible from the sheath wherein the shaft is configured for extending proximate to an Achilles tendon of a foot of a wearer positioned in the shoe such that the shaft is positioned for deflecting a bottom of a pant leg from entering a gap between the heelcap and the foot, the shaft being substantially rectangularly shaped when viewed from a back of the shoe, the shaft having upper corners, the upper corners being arcuate, the shaft comprising metal;

a sleeve positioned over and coupled to the shaft wherein the sleeve is configured for padding the shaft, the sleeve comprising at least one of rubber, silicone, and plastic; and a coupler coupled to the shaft, the coupler being selectively couplable to the heelcap wherein the coupler is positioned for coupling to the heelcap for fixedly positioning the shaft relative to the sheath, the coupler comprising:

a plurality of pairs of pins, the plurality of pairs of pins extending from proximate to an upper end to proximate to a lower end of the shaft, each pin of a respective pair of pins extending from a respective opposing side of the shaft, and a plurality of springs, each spring being coupled to and extending between the pins of a respective pair of pins such that the pins of the respective pair of pins are biased to an extended position wherein the pins of the respective pair of pins are positioned for extending from the shaft over the topline of the shoe as the shaft is extended from the sheath for retaining the shaft in an extended configuration, wherein the pins of the respective pair of pins are configured for depressing for inserting the shaft into the sheath, the plurality of pairs of pins comprising six pairs of pins.

* * * * *